US006577742B1

(12) United States Patent
Bruney

(10) Patent No.: US 6,577,742 B1
(45) Date of Patent: Jun. 10, 2003

(54) MEMBRANE SUPPORT SYSTEM

(76) Inventor: Paul F. Bruney, 12812 Meadowood Dr., Silver Spring, MD (US) 20904

( * ) Notice: Subject to any disclaimer, the term of this patent is extended or adjusted under 35 U.S.C. 154(b) by 0 days.

(21) Appl. No.: 09/981,401

(22) Filed: Oct. 17, 2001

(65) Prior Publication Data

(65)

Related U.S. Application Data

(63) Continuation-in-part of application No. 09/864,425, filed on May 24, 2001, now abandoned.

(51) Int. Cl.[7] ..... H04R 25/00

(52) U.S. Cl. ..... 381/398; 381/431; 181/171

(58) Field of Search ..... 381/396, 398, 381/152, 431, FOR 153; 181/171, 172

(56) References Cited

U.S. PATENT DOCUMENTS 3,247,925 A * 4/1966 Warnaka ..... 381/398
4,803,733 A * 2/1989 Carver et al. ..... 181/172

* cited by examiner

*Primary Examiner*—Huyen Le
(74) *Attorney, Agent, or Firm*—Lawrence E. Laubscher, Jr.

(57) ABSTRACT

A system for tensioning a membrane within a frame for a loudspeaker or a microphone is characterized by a frame containing an opening, a membrane connected to an exterior surface of the frame and spanning the frame opening, and a tensioning device connected with the frame for deflecting a portion of the membrane within the frame opening. The tensioning device is compliant thereby allowing the membrane to exhibit a high degree of flexure both within and beyond a plane containing the membrane.

12 Claims, 6 Drawing Sheets

MEMBRANE SUPPORT SYSTEM

This application is a continuation-in-part of application Ser. No. 09/864,425 filed May 24, 2001 now abandoned.

BACKGROUND OF THE INVENTION

The invention relates to a membrane support system which applies tension to the membrane of a sound producing or sound receiving device, such as a speaker or a microphone, respectively.

BRIEF DESCRIPTION OF THE PRIOR ART

The prior art relating to membrane support and tension systems utilize various techniques. The U.S. patents to Selinka U.S. Pat. No. 5,850,461, Carver U.S. Pat. No. 4,803,733, Thigpen U.S. Pat. No. 4,837,838, Torgeson U.S. Pat No. 4,468,530, and Recklinghausen U.S. Pat. No. 4,037,061 disclose rigidly affixing a loudspeaker membrane to a supporting structure. In other cases, membrane tension is applied by rigidly holding the membrane by the edges and introducing an inelastic deforming protuberance to apply membrane tension. The protuberance is positioned in grooves within the mounting structure. With each of the aforementioned references, the membrane edges are rigidly affixed so that no additional flexure of the membrane material is allowed. Consequently, the tension in the membrane must increase when it moves backward and forward from its center, or rest position. This limits the membrane excursion range, and thus the speaker's maximum acoustic output and dynamic range.

In the Bruney U.S. Pat. No. 4,939,784, front-to-back excursions of the membrane edges are prevented, and the membrane edges are allowed to move inward, in the plane of the membrane, as the central membrane moves back and forth. In this way, tension variation in the membrane is appreciably reduced and the useable excursion range of the membrane is increased. However, an apparatus for applying tension across the membrane is not disclosed.

SUMMARY OF THE INVENTION

The present invention is a membrane support system for applying tension to a membrane that is connected to a frame by incorporating a tensioning device that provides mechanical compliance in the direction of the plane of the membrane. The system includes a frame that has an opening, a membrane that is connected with an exterior surface of the frame and spans the frame opening, and a tensioning device that is connected with the frame for deflecting a portion of the membrane within the opening of the frame. The tensioning device includes a clamping member which is secured to the frame and extends over the frame opening, and a support formed of a compliant material that is connected with the end of the clamping member which extends over the frame opening. The compliant material of the tensioning device allows the membrane to exhibit a high degree of flexure both within and beyond, i.e. normal to, the plane containing the membrane.

According to a further object of the invention, the membrane support system includes a compliant roller which acts as a tensioning member for the membrane. The roller tensions the membrane within the plane thereof and the roller rotates in a plane parallel to the membrane plane during excursions of the membrane to relieve excess tension.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1:
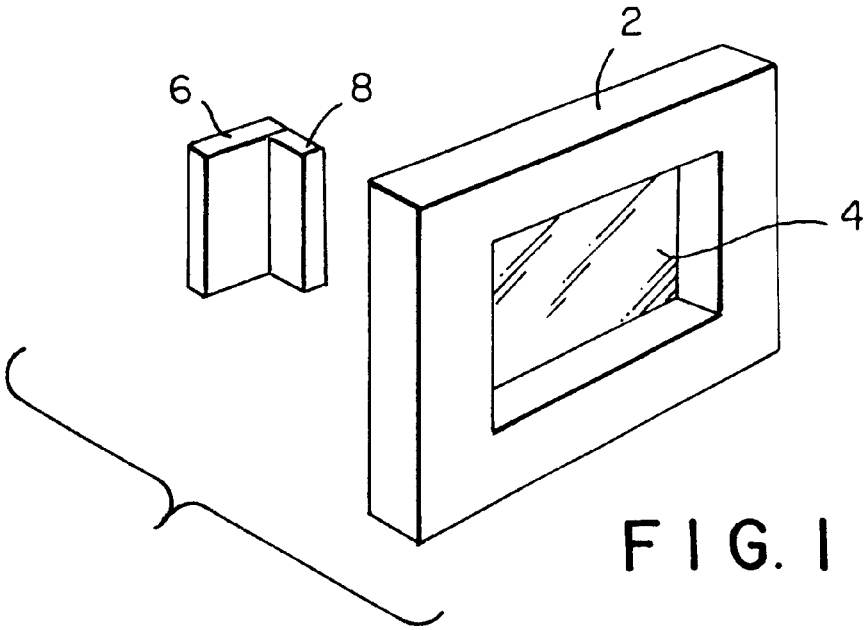
FIG. 1 is an exploded perspective view of the membrane support system according to the invention.
Figure 2:
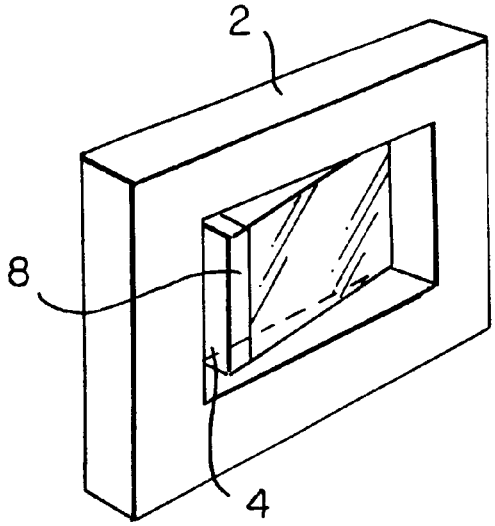
FIG. 2 is a perspective view of the assembled membrane support system of FIG. 1.
Figure 3:
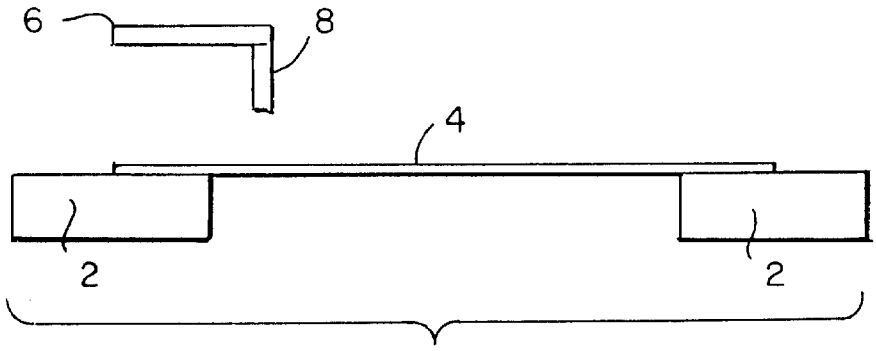
FIGS. 3 and 4 are top sectional views of the membrane support system of FIGS. 1 and 2, respectively.
Figure 4:
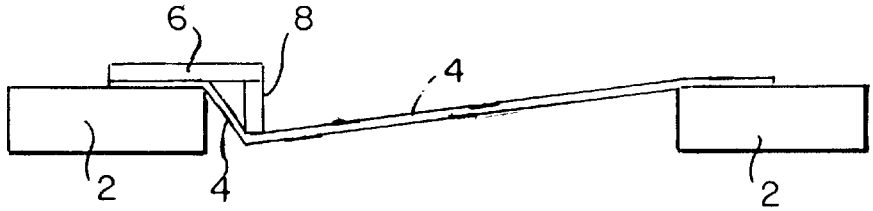

Referring now to FIGS. 2 and 4, the support 8 is placed through the opening of frame 2, thereby displacing and tensioning the membrane 4 in a direction normal to the original plane of the membrane which coincides with the plane containing an exterior surface of the frame to which the membrane is secured. The compliant attributes of the support 8 are essentially in the direction of the plane of the membrane 4 to allow the membrane to move in a direction normal to the original plane of the membrane when the membrane is activated. The clamping member 6 is connected with one side of the frame 2 by any suitable fastening devices such as nails, staples, tape, screws, or an adhesive, and the support 8 displaces the membrane 4 in a direction normal to the original plane of the membrane 4. In this configuration, the membrane 4 has a direction of compliance both within the plane of the membrane and also in a direction normal thereto.

Referring now to FIGS. 2 and 4, the support 8 is placed through the opening of frame 2, thereby displacing and tensioning the membrane 4 in a direction normal to the original plane of the membrane. The compliant attributes of the support 8 are essentially in the direction of the plane of the membrane 4 to allow the membrane to move in a direction normal to the original plane of the membrane when the membrane is activated. The clamping member 6 is connected with one side of the frame 2 by any suitable fastening devices such as nails, staples, tape, screws, or an adhesive, and the support 8 displaces the membrane 4 in a direction normal to the original plane of the membrane 4. In this configuration, the membrane 4 has a direction of compliance both within the plane of the membrane and also in a direction normal thereto.

Figure 5:
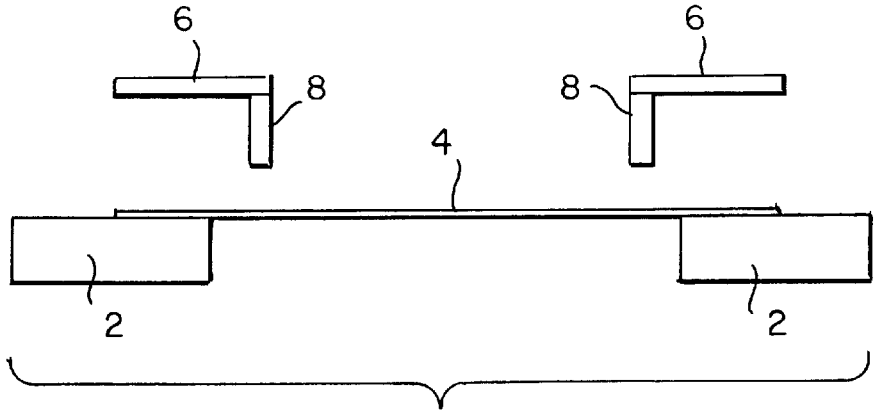
FIGS. 5 and 6 are exploded and assembled top sectional views, respectively, of an alternate membrane support system according to the invention.
Figure 6:
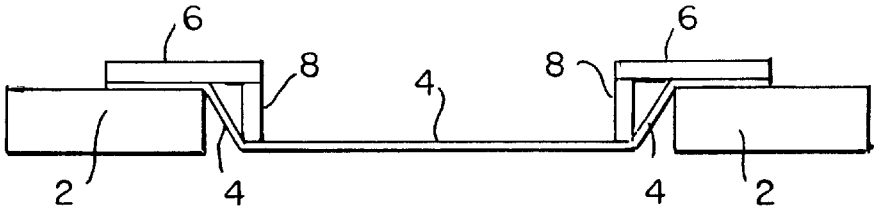

In the embodiment of FIGS. 5 and 6, a pair of clamping members 6 and supports 8 are connected with opposing ends of a frame 2. The supports 8 tension the membrane 4 within the frame opening in a direction normal to the original plane of the membrane 4. In this embodiment, the membrane 4 is tensioned on two opposing sides within the opening of frame 2.

Figure 7:
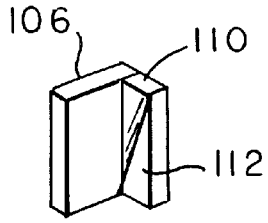
FIG. 7 is a perspective view of a membrane support according to another embodiment of the invention.
Figure 8:
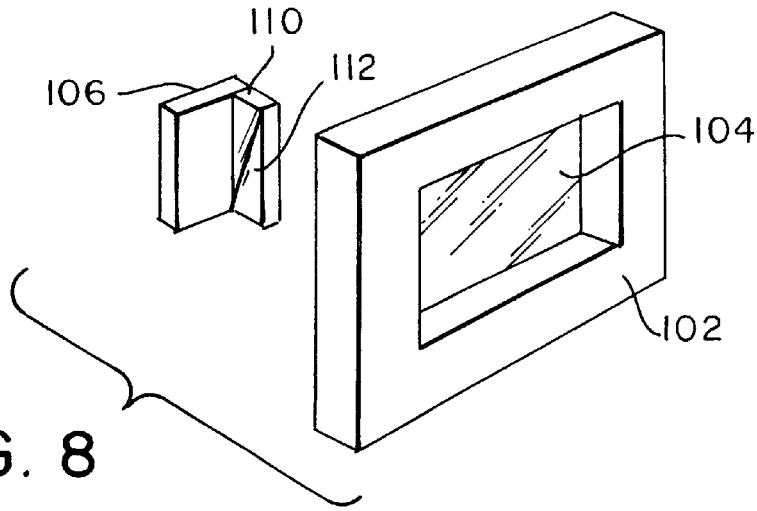
FIGS. 8 and 9 are exploded and assembled perspective views, respectively, of the membrane support system using the support of FIG. 7.
Figure 9:
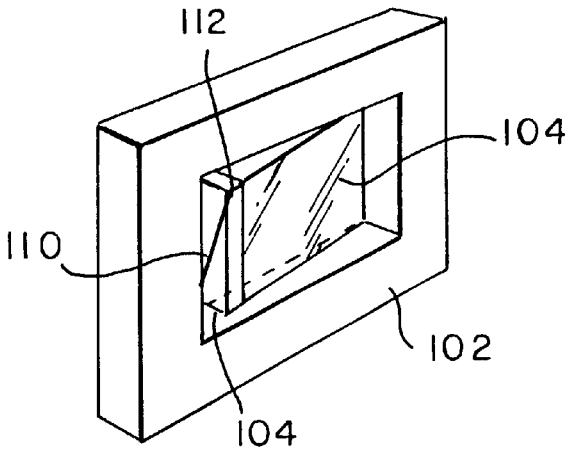

Referring now to the embodiment of FIGS. 7–9, a clamping member 106 is connected to an angular rigid support 110. The edge of the angular rigid support 110 opposite the clamping member 106 is tapered. A compliant support 112 is connected with the angular rigid support 110 along the tapered edge. The support 112 is formed of a compliant material. The compliant material and angular shape of the angular compliant support 112 when connected with the angular rigid support 110 provides a varying degree of compliance along the length of the support.

As shown in FIGS. 8 and 9, a membrane 104 is connected with the frame 102 and spans an opening therein. The clamping member 106 is connected with the frame and supports 110, 112 thereby to apply tension to the membrane. The stiffness of the membrane suspension is inversely proportional to its compliance. Greater stiffness (lower compliance) corresponds to a higher membrane resonance frequency, and lower stiffness (higher compliance) corresponds to a lower membrane resonance frequency. Because the compliance of the support 112 varies along its length; i.e., the support is more compliant at the bottom and less compliant at the top, the resulting suspension stiffness which the angular compliant support 112 exerts on the membrane 104 varies from one end to the other. The variation in suspension stiffness across the membrane 104 allows the membrane to produce varying degrees of sound from low bass tones to high treble tones.

A compliant support can also be used to apply varying tension to a membrane rather than varying only the suspension stiffness by deflecting different areas or portions of the edge of the membrane by different amounts. The smallest deflection from the smallest tension is suitable for the lowest frequency and the greatest deflection from the greatest tension is suitable for the highest frequency. This allows a membrane to produce varying degrees of sound from low bass tones to high treble tones. Either a compliant material of uniform height or a tapered compliant material may be used. In either case, the edge of the support that deflects the membrane in a perpendicular direction to its original plane is mounted at an angle with respect to the original plane so that one end of the support perpendicularly deflects the membrane more than the other end.

While the frame is illustrated and described as having a rectangular configuration, other shapes may be used as well including triangles, pentagons, circles and the like. Similarly, tension can be applied at any location around the perimeter of the opening, including on adjacent sides, continuously, on opposite sides or the like.

Figure 10:
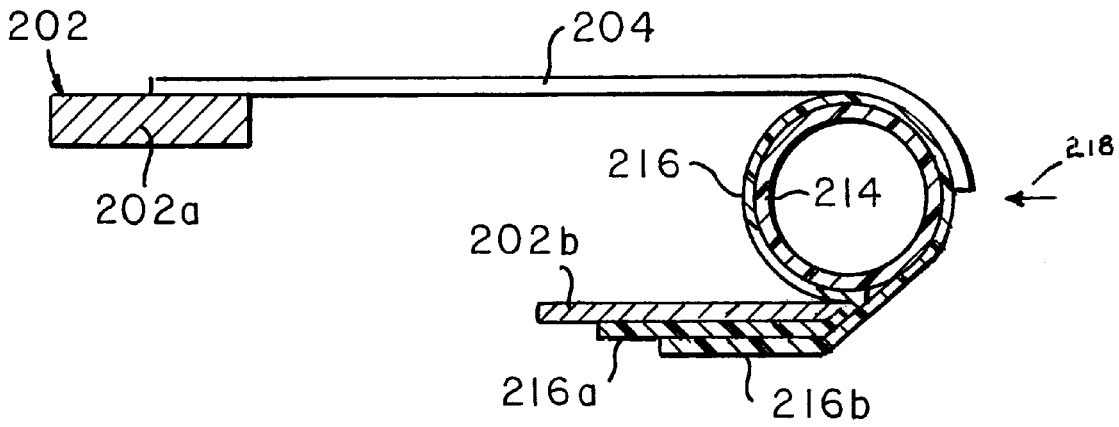
FIGS. 10–13 are top sectional views, respectively, of a membrane support system including a hollow roller for tensioning the membrane in the plane thereof.

Turning now to FIGS. 10–15, alternate embodiments of the invention including a compliant tensioning roller will be described. In FIG. 10, a frame 202 has offset portions 202*a* and 202*b* which are offset but spaced to define an opening. A membrane 204 is connected with the frame and includes a portion spanning the opening. The membrane is connected with the frame portion 202*a* via conventional fasteners (not shown) and with the frame portion 202*b* via a cylindrical roller 214. The roller is hollow and formed of a rigid material or a compliant material such as an elastomeric material, silicone, fluorosilicone, vinyl, foam, and the like.

Figure 11:
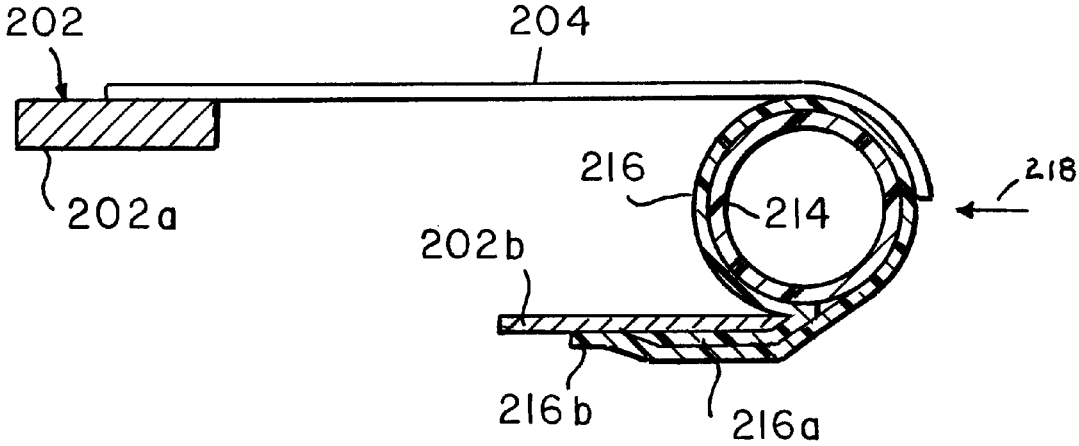

Surrounding the roller is a fastener film 216 which has a first end 216*a* connected with the frame portion 202*b*, such as with an adhesive, and a tension end 216*b* which overlaps the first end 216*a* for connection with the first end as in FIG. 10 or with the frame portion 202*b* as in FIG. 11. The degree of tension is governed by the amount of overlap. The membrane 204 is connected with the film by any suitable fastener such as an adhesive. When the membrane 204 undergoes excursions out of the normal plane thereof, the roller 214 rolls to the left as shown by the arrow 218 to relieve additional tension in the membrane resulting from the excursions.

Figure 12:
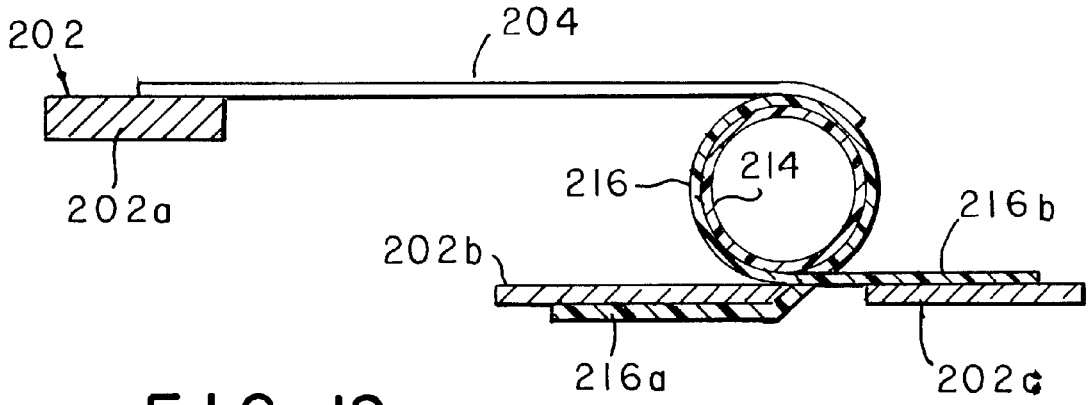

In the embodiment of FIG. 12, the tensioning end 216*b* of the fastener film 216 is connected with a separate portion 202*c* of the frame so that the tensioning end and the first end of the film are arranged on opposite sides of the roller to improve the tension relief effect thereof.

Figure 13:
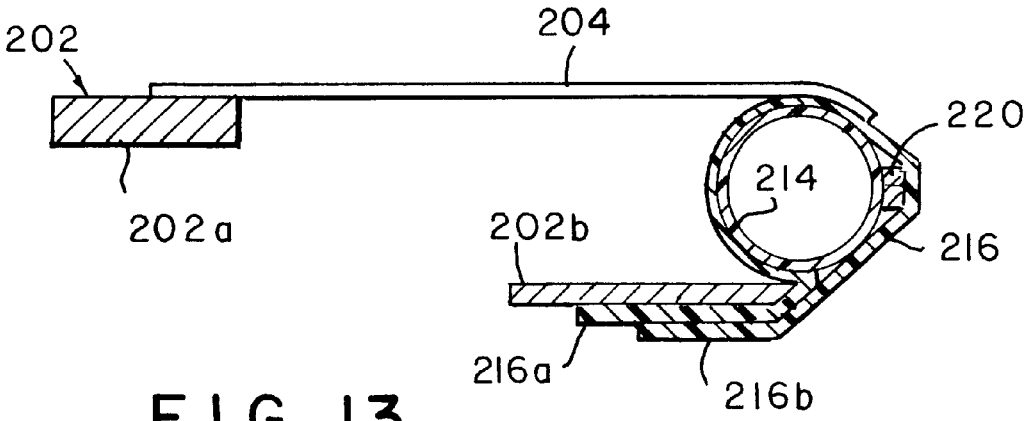

In FIG. 13, there is shown a fastener film connected with the roller and frame in a manner similar to that of FIG. 10, except that a spacer 220 is arranged between the roller and the fastener film. The spacer increases the torque applied by the tensioning end of the fastener film.

The fastener film is shown as a single film. However, two film strips may be used to achieve the same result.

Figure 14:
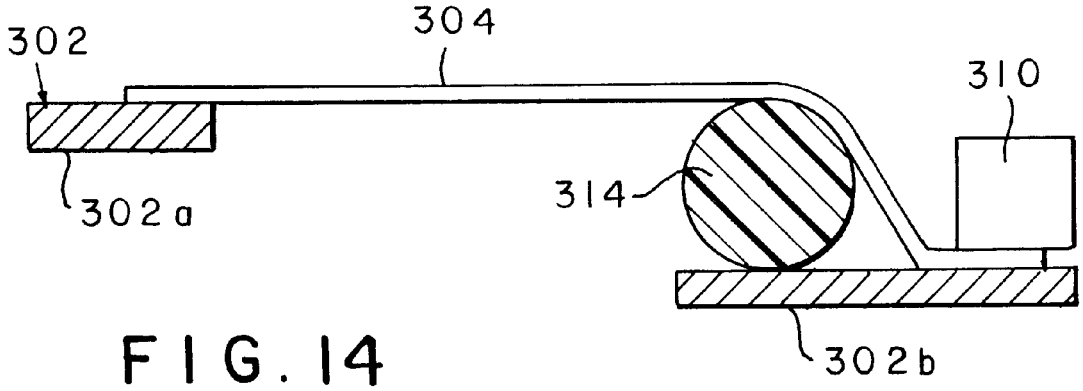
FIGS. 14 and 15 are top sectional views, respectively of a membrane support system including a compliant tensioning roller according to a further embodiment of the invention.
Figure 15:
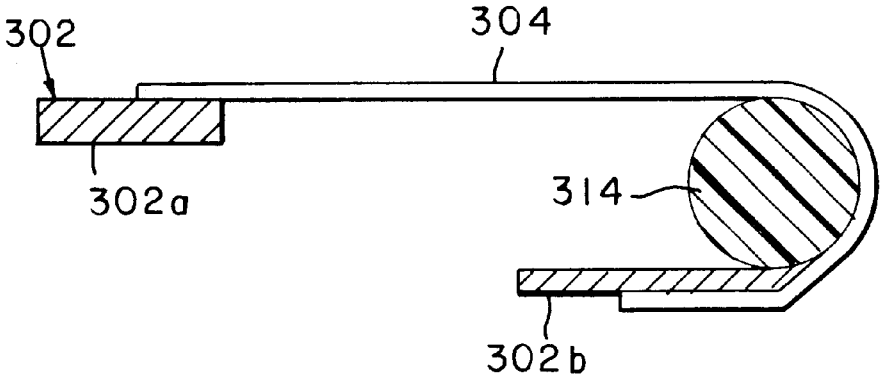

In FIGS. 14 and 15 are shown a further embodiment of the invention wherein the frame 302 comprises offset portions 302*a* and 302*b* and the tensioning roller comprises a solid cylindrical roller 314 formed of a rigid or a compliant material. A membrane 304 passes around the roller and is connected with the portion 302*b* via a clamp 310 (FIG. 14) or via an adhesive (FIG. 15). The membrane is also adhesively connected with the roller. As the membrane moves out of plane during, excursion thereof, the roller is displaced along the frame portion 302*b* to relieve tension.

In the embodiments of FIGS. 10–15, the diameter or height of the roller is selected so that the upper edge thereof is co-planar with the exterior surface of the frame first portion.

The roller preferably has a cylindrical configuration for use in tensioning a membrane across a rectangular frame. Other roller configurations are possible. For example, the roller may take the form of an O-ring if the membrane to which it is attached is round or oval.

While the preferred forms and embodiments of the invention have been illustrated and described, it will be apparent to those skilled in the art that various changes may be made without deviating from the inventive concepts set forth above.

What is claimed is:

1. A membrane support system, comprising:

(a) a frame containing an opening;

(b) a membrane connected to an exterior surface of said frame having a portion of which spans said frame opening;

(c) deflecting means connected with said frame for deflecting a portion of said membrane into said frame opening in a direction normal to a plane containing said exterior surface of said frame, said deflecting means being compliant, whereby said membrane has a high degree of flexure and is tensioned by said deflecting means.

2. The membrane support system as defined in claim 1, wherein said frame is formed of a rigid material.

3. The membrane support system as defined in claim 2, wherein said frame has a rectangular configuration.

4. The membrane support system as defined in claim 1, wherein said membrane is formed of a thin film material.

5. The membrane support system as defined in claim 1, wherein said deflecting means includes:

(1) a rigid clamping member, said clamping member being secured to said frame over said membrane and partially extending over said frame opening, and;

(2) a compliant support connected to said clamping member at the portion of said clamping member which extends over said frame opening, thereby to deflect said membrane normal to said plane and to provide increased compliance in said plane when said membrane moves off-center.

6. The membrane support system as defined in claim 5, wherein said deflecting means is mounted on one side of said frame opening, whereby said deflecting means deflects a portion of said membrane downwardly into said frame.

7. The membrane support system at defined in claim 6, wherein said deflecting means is mounted on two opposing sides of said frame opening, whereby said deflecting means deflect two portions of said membrane downwardly into said frame opening.

8. The membrane support system as defined in claim 5, wherein said deflecting means is mounted around the perimeter of said frame opening.

9. The membrane support system as defined in claim 5, wherein said compliant support is formed of an elastomeric material.

10. The membrane support system as defined in claim 5, wherein said compliant support comprises a variant compliant means, whereby a first edge of said compliant support is less compliant relative to a second opposite edge of said compliant support, thereby to vary the suspension stiffness said compliant support applies to said membrane, said suspension stiffness being greater on said membrane where said first edge of said compliant support meets said membrane than where said second edge of said compliant support meets said membrane.

11. A membrane support system for a loudspeaker, comprising:

(a) a frame containing an opening;

(b) a membrane connected to an exterior surface of said frame having a portion which spans said frame opening;

(c) means connected with said frame for deflecting a portion of said membrane into said frame opening in a direction normal to a plane containing said exterior surface of said frame, said deflecting means being compliant, whereby when an audio signal is delivered to said loudspeaker to drive said membrane, said membrane flexes more freely owing to said compliant deflector means, thereby to increase the output and efficiency of the loudspeaker.

12. A membrane support system for a microphone, comprising:

(a) a frame containing an opening;

(b) a membrane connected to an exterior surface of said frame having a portion which spans said frame opening;

(c) means connected with said frame for deflecting a portion of said membrane into said frame opening in a direction normal to a plane containing said exterior surface of said frame, said deflecting means being compliant, whereby when an audio signal is received by said microphone to actuate said membrane, said membrane flexes more freely owing to said compliant deflector means, thereby to increase the efficiency of the microphone.

* * * * *